US010221855B2

(12) United States Patent
Post et al.

(10) Patent No.: US 10,221,855 B2
(45) Date of Patent: Mar. 5, 2019

(54) FURNACE AIR HANDLER BLOWER ASSEMBLY UTILIZING A MOTOR CONNECTED TO AN IMPELLER FAN THAT IS SUSPENDED WITH MOUNTING ARMS

(71) Applicant: Regal Beloit America, INC., Beloit, WI (US)

(72) Inventors: Steven W. Post, Cassville, MO (US); Matthew Turner, Menzies Creek (AU); Steven Camilleri, Woolner (AU)

(73) Assignee: Regal Beloit America, Inc., Beloit, WI (US)

( * ) Notice: Subject to any disclaimer, the term of this patent is extended or adjusted under 35 U.S.C. 154(b) by 576 days.

(21) Appl. No.: 13/627,557

(22) Filed: Sep. 26, 2012

(65) Prior Publication Data

US 2014/0023521 A1 Jan. 23, 2014

Related U.S. Application Data

(60) Provisional application No. 61/674,087, filed on Jul. 20, 2012.

(51) Int. Cl.
*F04D 17/16* (2006.01)
*F04D 25/06* (2006.01)
*F04D 29/28* (2006.01)

(52) U.S. Cl.
CPC ..... *F04D 17/162* (2013.01); *F04D 25/068* (2013.01); *F04D 25/0653* (2013.01); *F04D 29/282* (2013.01)

(58) Field of Classification Search
CPC .... F04D 17/162; F04D 25/06; F04D 25/0606; F04D 29/263; F04D 29/281;
(Continued)

(56) References Cited

U.S. PATENT DOCUMENTS 2,975,960 A 3/1961 Atalla
3,223,313 A * 12/1965 Kinsworthy ..... F04D 17/04 392/360
(Continued)

FOREIGN PATENT DOCUMENTS

EP 0408221 A2 1/1991
EP 0408221 * 3/1991 ..... F04D 29/42
(Continued)

OTHER PUBLICATIONS

Strelow, 'Axialflussmotor' Mar. 2001, '136275572017-03-20EP 1081386A2IMachTrans' (English Machine Translation).*
(Continued)

*Primary Examiner* — Kenneth J Hansen
(74) *Attorney, Agent, or Firm* — Thompson Coburn LLP; Alan H. Norman

(57) ABSTRACT

A blower assembly having a blower housing, an impeller fan within the blower housing, the impeller fan being adapted for rotation about an axis and having a plurality of impeller blades and having an axial length, a motor having a stator and a rotor, the motor having an axial length, the rotor being configured to rotate relative to the stator for rotation about the axis, the rotor and the impeller fan being coupled so that the impeller fan rotates with the rotor about the axis, wherein a ratio of the axial length of the motor to the axial length of the impeller fan is less than 0.3, and a motor support bracket operatively securing the stator to one of the first and second side walls of the blower housing.

17 Claims, 6 Drawing Sheets

(58) Field of Classification Search
CPC .... F04D 29/601; F04D 29/622; F04D 29/282; F04D 25/0653; F24F 11/02
USPC ..... 417/423.7, 423.15; 310/46, 62, 63; 415/102, 204, 206; 416/170 R, 178, 185, 416/186 R, 187, 223 B
See application file for complete search history.

(56) References Cited

U.S. PATENT DOCUMENTS

| | | | | |
|---|---|---|---|---|
| 3,401,871 | A * | 9/1968 | Crowe | 417/353 |
| 3,571,637 | A | 3/1971 | Henningsen et al. | |
| 3,775,029 | A | 11/1973 | Ranz | |
| 4,428,719 | A | 1/1984 | Hayashibara et al. | |
| 5,619,860 | A * | 4/1997 | Yuji et al. | 62/163 |
| 5,746,577 | A * | 5/1998 | Ito et al. | 416/178 |
| 5,874,796 | A | 2/1999 | Petersen | |
| 5,927,947 | A | 7/1999 | Botros | |
| 6,030,173 | A | 2/2000 | Bacchiocchi | |
| 6,076,795 | A | 6/2000 | Scheidel et al. | |
| 6,146,094 | A | 11/2000 | Obana et al. | |
| 7,112,910 | B2 | 9/2006 | Lopatinsky et al. | |
| 9,103,349 | B2 | 8/2015 | Oi et al. | |
| 2003/0235496 | A1 | 12/2003 | Eaton et al. | |
| 2005/0140233 | A1 | 6/2005 | Kojima et al. | |
| 2007/0098571 | A1 | 5/2007 | Nagamatsu | |
| 2008/0001488 | A1* | 1/2008 | Pyrhonen et al. | 310/60 R |
| 2008/0157616 | A1 | 7/2008 | Bulatow et al. | |
| 2008/0200113 | A1 | 8/2008 | Munn et al. | |
| 2008/0232962 | A1 | 9/2008 | Agrawal et al. | |
| 2009/0114205 | A1 | 5/2009 | Post | |
| 2009/0114206 | A1 | 5/2009 | Post | |
| 2009/0274551 | A1* | 11/2009 | Messmer | 415/148 |
| 2010/0019613 | A1 | 1/2010 | Saban et al. | |
| 2010/0254826 | A1* | 10/2010 | Streng | F04D 25/06 417/44.1 |
| 2010/0316511 | A1 | 12/2010 | Yen et al. | |
| 2011/0114073 | A2 | 5/2011 | Post | |
| 2011/0229358 | A1* | 9/2011 | Streng | F04D 25/082 417/423.14 |
| 2011/0243720 | A1 | 10/2011 | Post | |
| 2011/0318200 | A1 | 12/2011 | Takeshita | |
| 2013/0170945 | A1 | 7/2013 | Gatley, Jr. et al. | |

FOREIGN PATENT DOCUMENTS

| | | | | |
|---|---|---|---|---|
| EP | 1081386 | A2 | 3/2001 | |
| EP | 1536142 | A1 | 6/2005 | |
| FR | 2772437 | A1 | 6/1999 | |
| GB | 1403522 | A | 8/1975 | |
| GB | 2255452 | A | 11/1992 | |
| GB | 2260576 | A | 4/1993 | |
| JP | 2005-291050 | A | 10/2005 | |
| WO | 2002/003527 | A2 | 1/2002 | |
| WO | 2011/119574 | A1 | 9/2011 | |
| WO | 2012/012547 | A1 | 1/2012 | |
| WO | WO2012012547 | * | 1/2012 | F04D 29/32 |

OTHER PUBLICATIONS

International Search Report and Written Opinion for PCT/US2013/046596 dated Nov. 27, 2013.
Extended European Search Report for EP Application 13820440.9 dated Apr. 8, 2016.
International Preliminary Report on Patentability (Chapter I) for PCT/US2011/029378 dated Sep. 12, 2012.
International Preliminary Report on Patenability (Chapter II) for PCT/US2011/044702 dated Aug. 16, 2012.
International Search Report and Written Opinion for PCT/US2011/044702 dated Dec. 22, 2011.
Translation of the European Patent EP1081386, "Axial flux electric motor", Mar. 7, 2001, Strelow.

* cited by examiner

FURNACE AIR HANDLER BLOWER ASSEMBLY UTILIZING A MOTOR CONNECTED TO AN IMPELLER FAN THAT IS SUSPENDED WITH MOUNTING ARMS

CROSS REFERENCE TO RELATED APPLICATIONS

This application claims the benefit of U.S. Provisional Patent Application 61/674,087 that was filed Jul. 20, 2012 and is incorporated herein by reference in its entirety.

BACKGROUND OF THE INVENTION

A disadvantage with a standard furnace air handler is the lack of energy savings that is now currently expected by customers. Consequently, there are applications where a high efficiency motor is required or an ultra-high efficiency motor is requested by customers. Furthermore, the noise and sound can be too high to be acceptable to the consumer who currently owns a standard furnace air handler. This may include a high efficiency distribution blower ("HEB"). Another disadvantage with current designs is that the electronics associated with a motor can restrict air flow because the inlet space is not fully open.

The present invention is directed to overcoming one or more of the problems set forth above.

SUMMARY OF INVENTION

In one aspect of the invention, a blower assembly is disclosed. The blower assembly includes a blower housing having a first air inlet opening in a first side wall and a second air inlet opening in a second side wall, an impeller fan within the blower housing, the impeller fan being adapted for rotation about an axis and having a plurality of impeller blades and having an axial length, a motor having a stator and a rotor, the motor having an axial length, the rotor being configured to rotate relative to the stator for rotation about the axis, the rotor and the impeller fan being coupled so that the impeller fan rotates with the rotor about the axis, wherein a ratio of the axial length of the motor, without extensions, to the axial length of the impeller fan is less than 0.3, and a motor support bracket operatively securing the stator to one of the first and second side walls of the blower housing.

In still another aspect of the invention, a blower assembly is disclosed. The blower assembly includes a blower housing having a first air inlet opening in a first side wall and a second air inlet opening in a second side wall, an impeller fan within the blower housing, the impeller fan being adapted for rotation about an axis and having a plurality of impeller blades and having an axial length, a motor having a stator and a rotor, the motor having a frame, having a width, in the form of a geometric shape and having an air directing surface to direct air generally radially outwardly towards the impeller fan, wherein a ratio of the width of the frame, to the axial length of the impeller fan is less than 0.3, and a motor support bracket operatively securing the stator to one of the first and second side walls of the blower housing.

In another aspect of the invention, a blower assembly is disclosed. The blower assembly includes a blower housing having a first side wall and a second side wall with an air inlet opening in the first side wall, an impeller fan within the blower housing, the impeller fan being adapted for rotation about an axis and having a plurality of impeller blades and having an axial length, a motor having a stator and a rotor, the motor having an axial length, the rotor being configured to rotate relative to the stator for rotation about the axis, the rotor and the impeller fan being coupled so that the impeller fan rotates with the rotor about the axis, wherein a ratio of the axial length of the motor, without extensions, to the axial length of the impeller fan is less than 0.3, and a motor support bracket operatively securing the stator to one of the first and second side walls of the blower housing.

In still yet another aspect of the invention, a blower assembly is disclosed. The blower assembly includes a blower housing having a first air inlet opening in a first side wall and a second air inlet opening in a second side wall, an impeller fan within the blower housing, the impeller fan being adapted for rotation about an axis and having a plurality of impeller blades and having an axial length, a pancake motor having a stator and a rotor, the motor having an axial length, the rotor being configured to rotate relative to the stator for rotation about the axis, wherein a ratio of the axial length of the motor, without extensions, to the axial length of the impeller fan is less than 0.3, a motor support bracket operatively securing the stator to one of the first and second side walls of the blower housing, a stationary plate that is attached to the stator, a drive plate that is operatively attached to the rotor and the impeller fan, and a bearing mechanism located between the stationary plate and the drive plate that allows rotatable movement for the drive plate in relationship to the stationary plate so that the rotor and the impeller fan are coupled so that the impeller fan rotates with the rotor about the axis.

Still yet another aspect of the present invention is a method for utilizing a blower assembly is disclosed. The method includes utilizing a blower housing having a first air inlet opening in a first side wall and a second air inlet opening in a second side wall, utilizing an impeller fan within the blower housing, the impeller fan being adapted for rotation about an axis and having a plurality of impeller blades and having an axial length, utilizing a motor having a stator and a rotor, the motor having an axial length, the rotor being configured to rotate relative to the stator for rotation about the axis, the rotor and the impeller fan being coupled so that the impeller fan rotates with the rotor about the axis, wherein a ratio of the axial length of the motor, without extensions, to the axial length of the impeller fan is less than 0.3 with a motor support bracket operatively securing the stator to one of the first and second side walls of the blower housing.

Yet another aspect of the present invention is a method of selling a motor to an assembler of a blower assembly is disclosed. The method includes providing a motor to an assembler of a blower assembly, wherein the motor includes a stator and a rotor, the motor having an axial length, the rotor being configured to rotate relative to the stator for rotation about the axis, the rotor and the impeller fan being coupled so that the impeller fan rotates with the rotor about the axis, wherein a ratio of the axial length of the motor, without extensions, to an axial length of an impeller fan utilized in a blower assembly is less than 0.3.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

Figure 1:
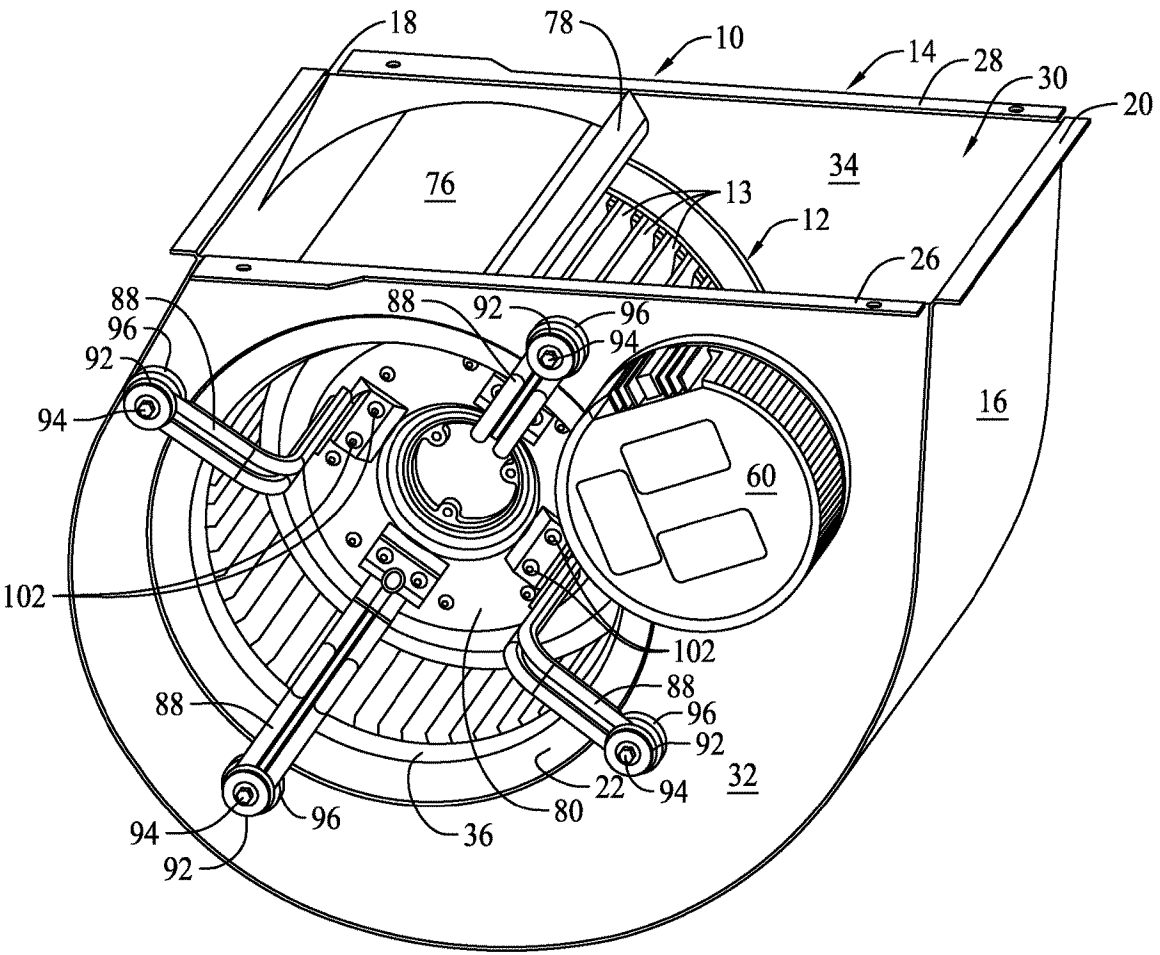
FIG. 1 is the perspective front side view of a blower assembly of the present invention revealing the outlet opening and first side wall.

Reference characters in the written specification indicate corresponding items shown throughout the drawing figures.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as to obscure the present invention.

A typical construction of an air handler blower assembly is shown in a "Furnace Air Handler Blower Housing with an Enlarged Air Outlet Opening" found in U.S. Patent Publication No. 2011/0114073, U.S. patent application Ser. No. 12/178,161, filed Jul. 23, 2008, and published on May 19, 2011, which is incorporated herein by reference, in its entirety. Another illustrative example of an air handler blower assembly is shown in "Furnace Air Handler Blower Housing with an Enlarged Air Outlet Opening" found in U.S. Patent Publication No. 2009/0114205, U.S. patent application Ser. No. 11/935,726, filed Nov. 6, 2007, and published on May 7, 2009, which is incorporated herein by reference, in its entirety.

Referring now to FIG. 1 which is a front perspective view of a furnace air handler blower assembly of the present invention. The furnace of the invention is primarily constructed in the same manner as other known high efficiency furnaces. There is a blower assembly that is generally indicated by numeral 10. The blower assembly 10 includes the impeller fan 12 that is contained with a blower housing 14. The blower housing 14 has an outer wall 16 having a scroll-shaped length that extends from a first end edge 18 of the outer wall 16 to an opposite second end edge 20 of the outer wall 16. The blower housing 14 includes a top portion 76 and a cutoff 78.

The blower housing 14 also includes a first side wall 32 and a second side wall 34. Portions of the peripheries of the first side wall 32 and the second side wall 34 are connected to the opposite sides of the outer wall 16. The first side wall 32 has a first straight edge portion 26 and the second side wall 34 has a second straight edge portion 28. The first straight edge portion 26 and second straight edge portion 28 of the first side wall 32 and the second side wall 34, respectively, are also positioned at opposite sides of an outlet opening 30, which is preferably, but not necessarily, rectangular, of the blower housing 14 with the outer wall 16, the first end edge 18 and the second end edge 20 defining the outlet opening 30, which preferably, but not necessarily, have a rectangular configuration. The first side wall 32 includes a first circular aperture 36, which is through the first side wall 32. The second side wall 34 includes a second circular aperture 38, shown in FIG. 2, which is through the second side wall 34. The first circular aperture 36 and the second circular aperture 38 are coaxially aligned and function as the air inlet openings of the blower housing 14. This dual inlet system for the blower assembly 10 is highly efficient. However, a single inlet or multiple inlets may be utilized. There is a first curved portion 22 extending between the first side wall 32 that includes a first circular aperture 36 and a second curved portion 24 extending between the second side wall 34 and the second circular aperture 38.

Figure 2:
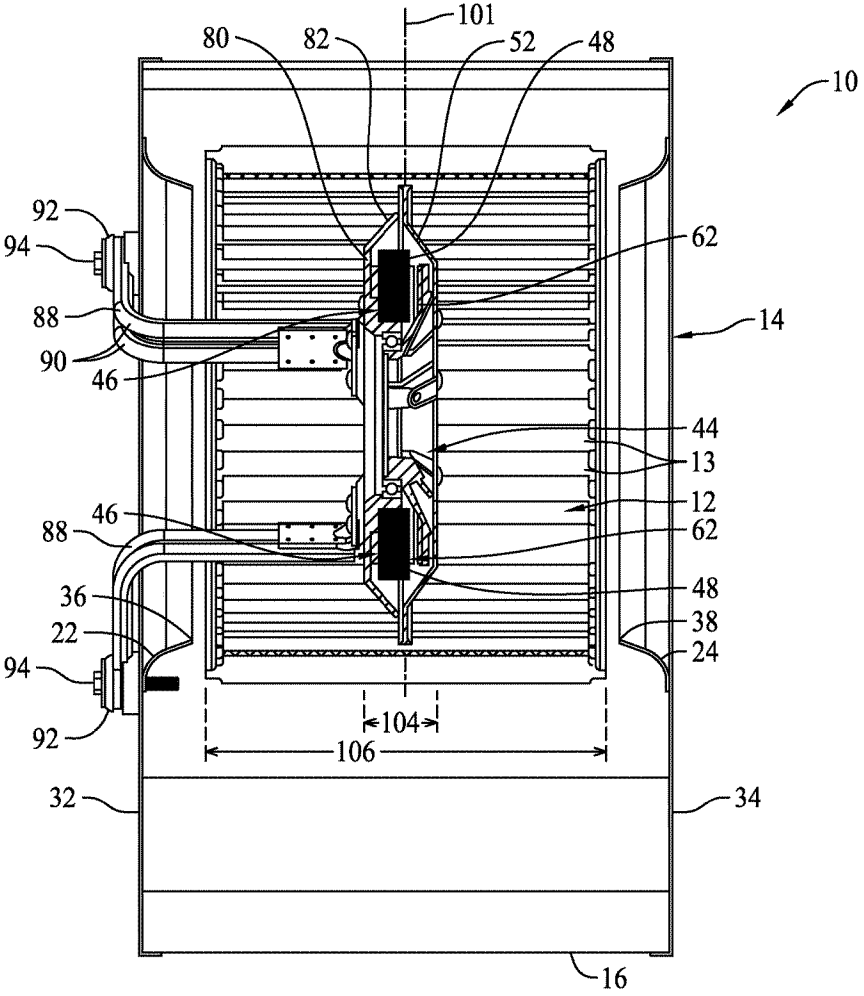
FIG. 2 is a perspective top view of the blower assembly of the present invention, shown in FIG. 1, without the top portion of the blower housing and a cutoff.
Figure 3:
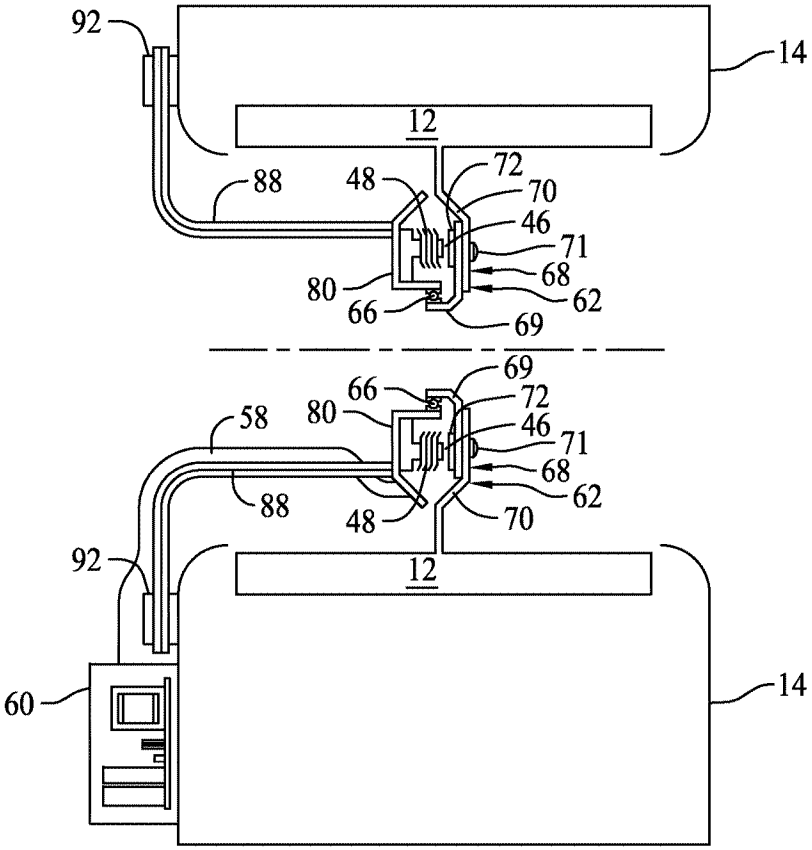
FIG. 3 is schematic representation of the embodiment of the blower assembly of the present invention shown in FIGS. 1 and 2.
Figure 5:
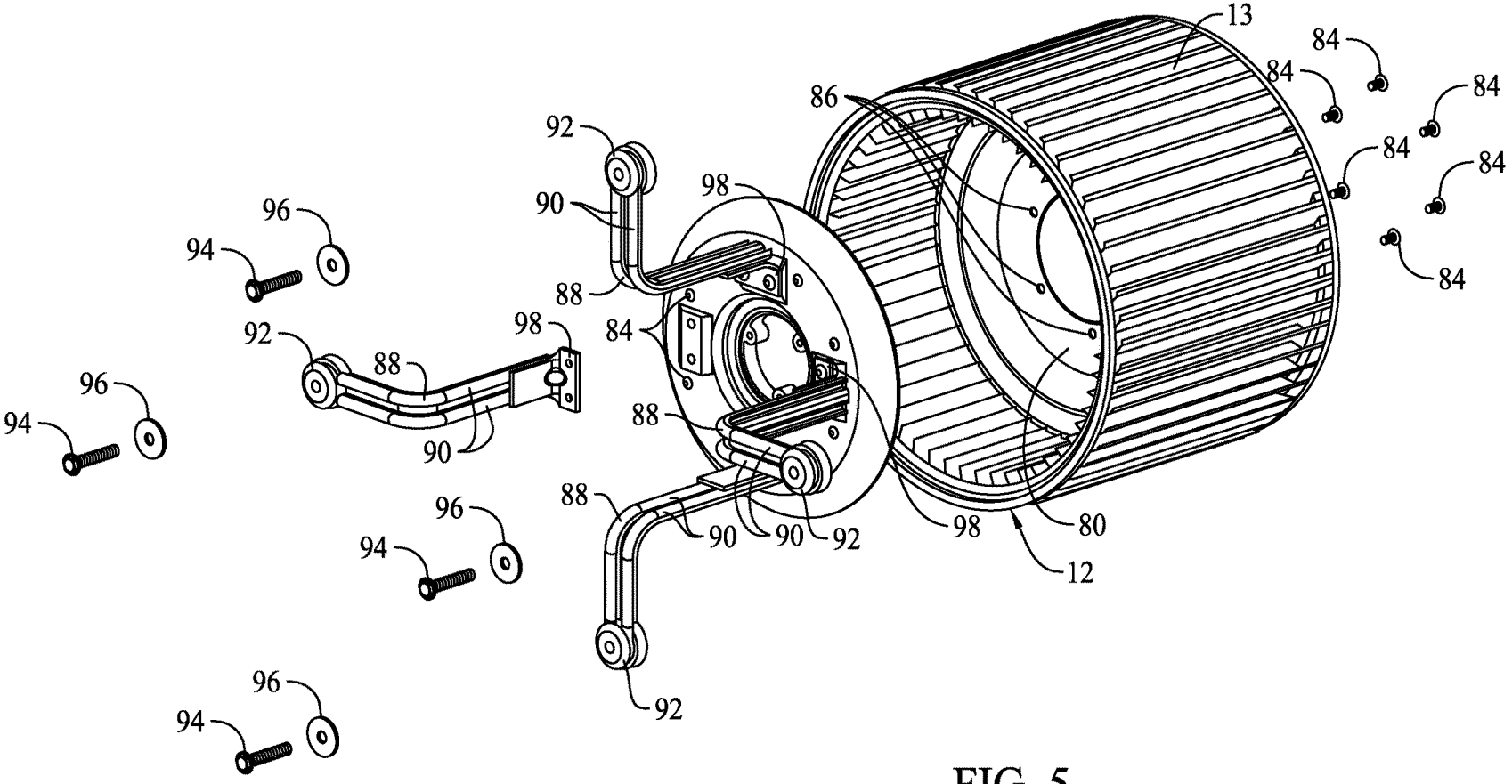
FIG. 5 is an exploded side perspective view of a fan wheel with a series of mounting legs and attachment mechanisms, shown in FIG. 1.
Figure 6:
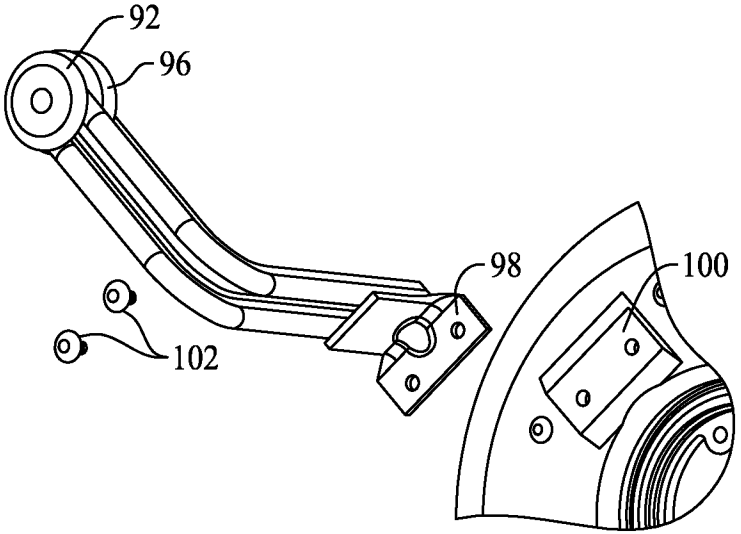
FIG. 6 is an isolated view of a single mounting leg having an attachment bracket on a first end portion for mounting on a mounting plate and an isolation mount attached to the second end portion of the single mount leg for attachment to a sidewall of a blower housing.

The motor 44 of the blower assembly 10 is preferably, but not necessarily, an axial flux motor, as shown in FIG. 2. Optimally, the motor 44 is a pancake motor. The outer edge 82 of the frame 52 for the motor 44 is preferably angled to allow a clear air flow path into the series of air flow impeller blades 13, as shown in FIG. 2. However, with this present invention, any of a myriad of motors will suffice. The stator 46 of the motor 44 is attached to a stationary plate 80, as shown in FIG. 3 through a second series of attachment mechanisms 84, e.g., nut and bolt combinations, through a series of openings 86, as shown in FIGS. 5 and 6. There is a drive plate 68 that is attached to the impeller fan 12 to allow the rotor 62 to rotate the impeller fan 12, as shown in FIG. 3. The drive plate 68 may optionally include a first connecting portion 69 and a second connecting portion 70 that are fixedly attached together by an attachment mechanism 71, e.g., rivets, which connects the permanent magnets 72 for the rotor 62 that opposes the stator windings 48. In this illustrative, but nonlimiting example, a bearing mechanism 66, e.g., bearings, allows rotatable movement for the first connecting portion 69 in relationship to the stationary plate 80. The second connecting portion 70 is attached to the impeller fan 12.

The blower assembly 10 is constructed in such a manner that allows for the wiring 58 associated with the stator 46 of the motor 44 to be run through to an electronic controller 60, as shown in FIG. 3. In the illustrated, but nonlimiting, embodiment of the blower assembly 10, the stator 46 has thirty-six (36) slots and eighteen (18) stator windings 48. In the illustrated, but nonlimiting, embodiment, thirty (30) permanent magnets 72 are employed on the rotor 62.

Figure 4:
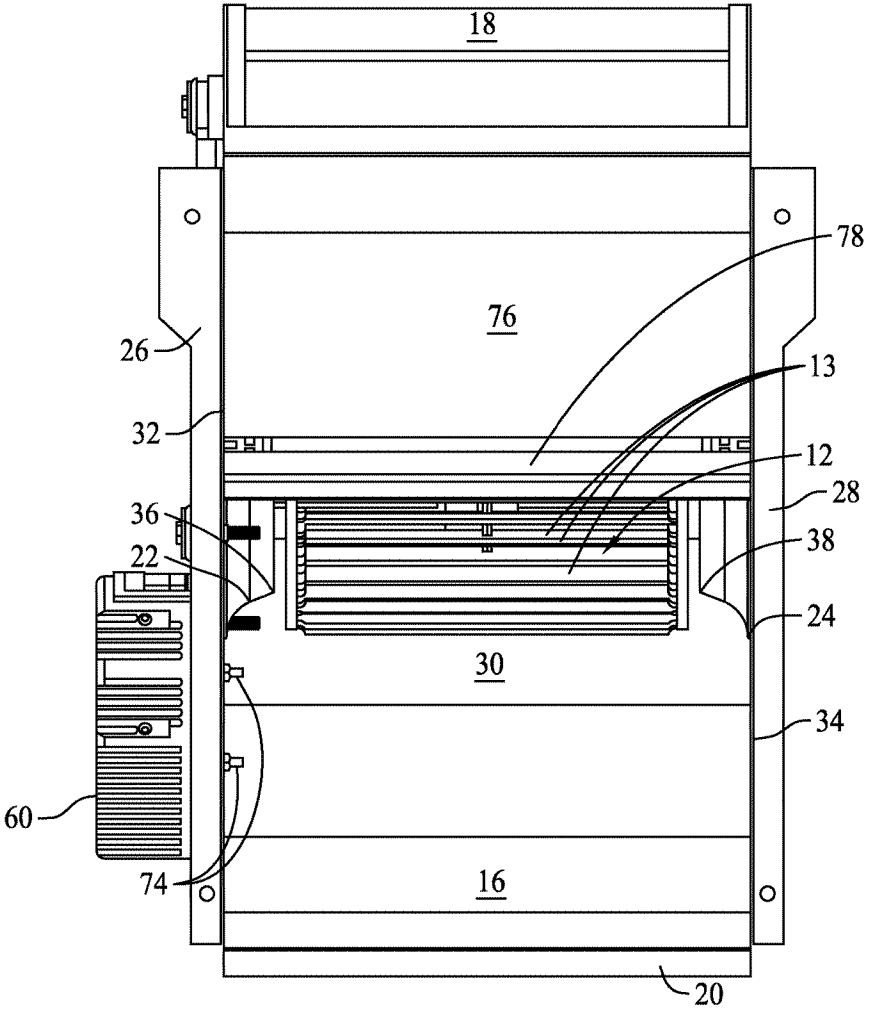
FIG. 4 is a perspective top view of the blower assembly of the present invention, shown in FIG. 2, that includes the top portion of the blower housing and a cutoff.

As also shown in FIG. 4, the electronic controller 60 is preferably, but not necessarily, mounted to the blower housing 14 by a first series of attachment mechanisms 74, e.g., nut and bolt combinations, preferably, but not necessarily, two (2). This increases efficiency by removing the electronics from the motor 44 in order to open fully the inlet space to provide improved air flow. The electronic controller 60 is not defined as being part of the motor 44 for determining the axial length of the motor 44.

Referring now to FIG. 3, the impeller fan 12 with the series of air flow impeller blades 13 are connected to the rotor 62 of the motor 44. As shown in FIG. 2, the motor 44 can vary in position from the center of the blower 101 by a percentage of less than plus or minus thirty percent (30%) of the axial length of the impeller fan, indicated by reference number 106, and preferably can vary in position from the center of the blower 101 by a percentage of less than plus or minus twenty percent (20%) and optimally preferably can vary in position from the center of the blower 101 by a percentage of less than plus or minus ten percent (10%).

The stationary plate 80 is secured to the stator 46 of the motor 44 through a series of mounting legs 88 that are attached to the first side wall 32, shown in FIGS. 1, 3, 5 and 6. There are preferably, but not necessarily, four (4). Preferably, the series of mounting legs 88 are pre-formed structures with reinforced sidewalls 90. There are a series of isolation mounts 92 that are connected to the series mounting legs 88 that receive a third series of attachment mechanisms 94, e.g., threaded bolts, e.g., preferably, but not necessarily, four (4). Optionally, a series of washers 96, e.g., preferably, but not necessarily, four (4), can be located between the third series of attachment mechanisms 94 and the first side wall 32, as shown in FIG. 1. The other end of the series of mounting legs 88 are attached to a corresponding series of attachment brackets 98, which are preferably hinged, as shown in FIG. 6. Attachment is preferably, but not necessarily, through a wide variety of attachment means and mechanisms, that include spot welding. The series of mounting legs 88 are preferably, but not necessarily, pre-formed to eliminate belly bands, large stampings and die castings.

There are a corresponding series of mounting plates 100 that receive a fourth series of attachment mechanisms 102, e.g., threaded bolts, e.g., preferably, but not necessarily, two (2) that connect the attachment brackets 98 to the series of mounting plates 100, as shown in FIG. 6. This design assists in minimizing cocking during assembly. The series of air flow impeller blades 13 can be any of a wide variety of shapes and dimensions with the preferred embodiment being a forward curve as shown in FIG. 5.

The axial length of the motor 44 or thickness of the frame 52 of the motor 44 indicated by numeral 104 should be a ratio to the width of the impeller fan 12 indicated by numeral 106 less than 0.3, as shown in FIG. 2. Preferably this ratio is less than 0.26 and optimally this ratio is less than 0.211. As used herein and in the claims, the axial length of the motor 44 or thickness of the frame 52 of the motor 44 indicated by numeral 104 does not include any bearing journal extension, and does not include any portion of any axial extension, axial protrusion or other contrivance that is radially within a distance from the rotor axis of rotation of twenty percent of the radius of the impeller (i.e., the radial distance from the rotor axis of rotation to radially inner-most edges of the impeller blades), where air performance has a minimal impact. The frame 52 of the motor 44 has an air directing surface to direct air generally radially outwardly towards the impeller fan 12. Therefore, any extensions, protrusions, or other augmentations to the frame 52 cannot be considered part of the axial length of the motor 44 or thickness of the frame 52 of the motor 44.

There are numerous potential ways to position the electronic controller 60 for the motor 44, e.g., axial flux motor, as shown in FIG. 3. The motor 44 is shaftless to provide a compact design that eliminates shaft resonance that can be impacted by magnet cogging. Illustrative, but nonlimiting, examples of numerous other ways of mounting the electronic controller 60 and running the wiring 58 are found in International Application No. PCT/US2011/044702 for "Blower Assembly with Motor Integrated into the Impeller Fan and Blower Housing Constructions," filed Jul. 20, 2011, claiming a priority of Jul. 20, 2010, which is incorporated by reference herein, in its entirety. An illustrative, but nonlimiting, example of an axial flux motor is found in International Application No. PCT/US2011/119574 for "Axial Flux Electric Machine and Methods of Assembling the Same," filed Mar. 22, 2011, claiming a priority of Mar. 22, 2010, which is incorporated by reference herein, in its entirety.

Furthermore, it should be understood that when introducing elements of the present invention in the claims or in the above description of the preferred embodiment of the invention, the terms "have," "having," "includes" and "including" and similar terms as used in the foregoing specification are used in the sense of "optional" or "may include" and not as "required." Similarly, the term "portion" should be construed as meaning some or all of the item or element that it qualifies.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

The invention claimed is:

1. A blower assembly comprising:

a blower housing having a first air inlet opening in a first side wall and a second air inlet opening in a second side wall;

an impeller fan within the blower housing, the impeller fan being adapted to rotate about an axis and having a plurality of impeller blades and having an axial length;

a motor having a stator, a rotor, a first peripheral air directing surface, and a second peripheral air directing surface, the stator and the rotor being axially opposed relative to the axis and adapted and configured to operate as an axial flux motor, the rotor and the impeller fan being coupled so that the impeller fan rotates with the rotor about the axis, the first peripheral air directing surface diverging away from the first inlet opening to direct air drawn through the first inlet opening radially outwardly toward the impeller blades of the impeller fan, the first peripheral air directing surface being fixed relative to the stator such that the first peripheral air directing surface remains stationary when the impeller fan rotates about the axis, the second peripheral air directing surface diverging away from the second inlet opening to direct air drawn through the second inlet opening radially outwardly toward the impeller blades of the impeller fan, the second peripheral air directing surface being attached to the rotor and adapted to rotate with the rotor and the impeller fan, the motor having an axial length, the rotor being configured to rotate relative to the stator about the axis, the rotor and the impeller fan being coupled so that the impeller fan rotates with the rotor about the axis; and a motor support bracket operatively securing the stator to one of the first and second side walls of the blower housing.

2. The blower assembly as set forth in claim 1, wherein the axial length of the motor has a midpoint and the axial length of the impeller fan has a midpoint, the midpoint of the axial length of the motor is off-set from the midpoint of the axial length of the impeller fan by less than thirty percent of the axial length of the impeller fan.

3. The blower assembly as set forth in claim 1, wherein the axial length of the motor has a midpoint and the axial length of the impeller fan has a midpoint, the midpoint of the axial length of the motor is off-set from the midpoint of the axial length of the impeller fan by less than twenty percent of the axial length of the motor.

4. The blower assembly as set forth in claim 1, wherein the axial length of the motor has a midpoint and the axial length of the impeller fan has a midpoint, the midpoint of the axial length of the motor is off-set from the midpoint of the axial length of the impeller fan by less than ten percent of the axial length of the impeller fan.

5. The blower assembly as set forth in claim 1, further comprising a stationary plate that is operatively attached to the stator of the motor and a drive plate that is operatively attached to the rotor of the motor, and at least one bearing mechanism located between the stationary plate and the drive plate that allows rotatable movement for the drive plate in relationship to the stationary plate.

6. The blower assembly as set forth in claim 5, wherein the motor support bracket comprises a plurality of mounting legs, each mounting leg being a part separate from each of the other mounting legs, each mounting leg having a first end portion operatively attached to one of the first and second side walls of the blower housing and a second end portion that is operative secured to the stationary plate.

7. The blower assembly as set forth in claim 5, wherein the plurality of mounting legs includes reinforced sidewalls.

8. The blower assembly as set forth in claim 1, further comprising an electronic controller, the electronic controller being configured to control at least one operation of the motor, the electronic controller being attached to one of the first and second side walls of the blower housing.

9. The blower assembly as set forth in claim 1, further comprising an electronic controller, the electronic controller being configured to control at least one operation of the motor, wherein the electronic controller is located outside of an airflow path located within the blower housing.

10. The blower assembly as set forth in claim 1, further comprising a bearing mechanism, wherein the stator and the rotor are coupled by the bearing mechanism such that the motor is shaftless.

11. The blower assembly as set forth in claim 1, further comprising a drive plate, the stator including stator windings, the rotor including permanent magnets that oppose the stator windings, the drive plate coupled to the impeller fan and directly coupled to at least one of the permanent magnets of the rotor by an attachment mechanism.

12. The blower assembly as set forth in claim 11, wherein the drive plate is adapted and configured to form the second peripheral air directing surface.

13. A blower assembly comprising:

a blower housing having a first air inlet opening in a first side wall and a second air inlet opening in a second side wall;

an impeller fan within the blower housing, the impeller fan being adapted to rotate about an axis and having a plurality of impeller blades;

a motor having a stator, a rotor, a first peripheral air directing surface, and a second peripheral air directing surface, the stator and the rotor being axially opposed relative to the axis and adapted and configured to operate as an axial flux motor, the rotor being configured to rotate relative to the stator about the axis, the rotor and the impeller fan being coupled so that the impeller fan rotates with the rotor about the axis, the first peripheral air directing surface diverging away from the first inlet opening to direct air drawn through the first inlet opening radially toward the impeller blades of the impeller fan, the second peripheral air directing surface diverging away from the second inlet opening to direct air drawn through the second inlet opening radially toward the impeller blades of the impeller fan, the first peripheral air directing surface being adjacent and gapped from the second peripheral air directing surface, the first peripheral air directing surface remaining stationary relative to the stator when the impeller fan rotates about the axis and the second peripheral air directing surface being adapted to rotate with the impeller.

14. The blower assembly as set forth in claim 13, further comprising an electronic controller, the electronic controller being configured to control at least one operation of the motor, the electronic controller being attached to one of the first and second side walls of the blower housing.

15. The blower assembly as set forth in claim 13, further comprising a bearing mechanism, wherein the stator and the rotor are coupled by the bearing mechanism such that the motor is shaftless.

16. The blower assembly as set forth in claim 13, further comprising a drive plate, the stator including stator windings, the rotor including permanent magnets that oppose the stator windings, the drive plate coupled to the impeller fan and directly coupled to at least one of the permanent magnets of the rotor by an attachment mechanism.

17. The blower assembly as set forth in claim 16, wherein the drive plate is adapted and configured to form the second peripheral air directing surface.

* * * * *